US008821950B2

(12) United States Patent
Nilsson et al.

(10) Patent No.: US 8,821,950 B2
(45) Date of Patent: Sep. 2, 2014

(54) ACCORDION SUSCEPTOR FOR MICROWAVE PREPARATION OF COOKIES

(75) Inventors: Urban Nilsson, Aurora, OH (US); Deborah Belser, Chagrin Falls, OH (US)

(73) Assignee: Nestec S.A., Vevey (CH)

( * ) Notice: Subject to any disclaimer, the term of this patent is extended or adjusted under 35 U.S.C. 154(b) by 795 days.

(21) Appl. No.: 12/594,125

(22) PCT Filed: Apr. 29, 2008

(86) PCT No.: PCT/EP2008/055284

§ 371 (c)(1), (2), (4) Date: Sep. 30, 2009

(87) PCT Pub. No.: WO2008/132216

PCT Pub. Date: Nov. 6, 2008

(65) Prior Publication Data

US 2010/0112145 A1 May 6, 2010

Related U.S. Application Data

(60) Provisional application No. 60/915,276, filed on May 1, 2007.

(51) Int. Cl.

| | |
|---|---|
| ***B65D 81/34*** | (2006.01) |
| ***B65D 77/00*** | (2006.01) |
| ***B32B 3/28*** | (2006.01) |
| ***A21D 13/00*** | (2006.01) |

(52) U.S. Cl.

CPC .... *B65D 81/3453* (2013.01); *B65D 2581/3441* (2013.01); *B65D 2581/3498* (2013.01); *B65D 2581/3495* (2013.01)

USPC ..... 426/107; 426/94; 426/109; 426/113; 426/114; 426/128; 426/144; 426/234; 426/243; 426/275; 426/391; 426/389; 426/412; 426/496; 426/549; 426/552; 426/653; 219/730; 219/634

(58) Field of Classification Search

CPC ..... A21D 2/00; A21D 6/001; A21D 8/00; A21D 8/02; A21D 8/06; A21D 17/00; A21D 17/004; A21D 17/006; A21D 13/0067; A21D 13/08; B65D 77/00; B65D 77/003; B65D 81/34; B65D 81/3453; B65D 81/3461; B65D 81/3466; B65D 2581/34; B65D 2581/344; B65D 2581/3405; B65D 2581/3406; B65D 2581/3408; B65D 2581/3437; B65D 2581/3456; B65D 2581/3463; B65D 2581/3471; B65D 2581/3494; B65D 2581/3495; B65D 2581/3497; B65D 2581/3498; A47J 36/027; A47J 37/00; A47J 37/01; A47J 37/015; A23L 1/00; A23L 1/0128; A23L 1/0255; B32B 3/28; B65B 25/16; H05B 6/105; Y10S 99/14

USPC ..... 426/412, 549, 109, 114, 243, 144, 128, 426/112–113, 107, 94, 234, 389, 275, 391, 426/496, 551, 552, 653; 219/730, 732, 634

See application file for complete search history.

(56) References Cited

U.S. PATENT DOCUMENTS

| | | | | |
|---|---|---|---|---|
| 4,911,939 | A * | 3/1990 | Lou et al. | 426/241 |
| 5,075,526 | A | 12/1991 | Sklenak et al. | 219/10.55 |
| 5,334,820 | A * | 8/1994 | Risch et al. | 219/730 |
| 5,885,630 | A * | 3/1999 | Zurawski et al. | 426/5 |
| 6,137,099 | A * | 10/2000 | Hamblin | 219/730 |
| 2007/0042085 | A1 * | 2/2007 | Haas | 426/94 |
| 2007/0084860 | A1 * | 4/2007 | Corcoran, Jr. | 219/730 |

FOREIGN PATENT DOCUMENTS

| | | | |
|---|---|---|---|
| GB | 2227398 | 7/1990 | |
| WO | WO 93/17532 | 9/1993 | |
| WO | WO 96/15958 | 5/1996 | |
| WO | WO 01/30657 | 5/2001 | |
| WO | WO 2004103077 A1 * | 12/2004 | A21B 5/02 |

OTHER PUBLICATIONS

International Search Report, PCT/EP2008/055284, mailed Aug. 14, 2008.

* cited by examiner

*Primary Examiner* — Rena L Dye
*Assistant Examiner* — Danny Chen
(74) *Attorney, Agent, or Firm* — Winston & Strawn LLP

(57) ABSTRACT

The present invention provides an innovative packaging for microwave preparation of expandable food, such as cookies, an innovative food product prepared from the packaging and the method of preparation thereof. The innovative packaging includes first and second susceptor sheet portions each having an accordion-like shape; one or more members for spacing the susceptor sheet portions at a predetermined distance; and an expandable uncooked food placed between the two susceptor sheets, wherein the food is in intimate contact with sheet portions and becomes efficiently browned and crisped during microwave cooking. The food is preferably a cookie dough.

16 Claims, 7 Drawing Sheets

ACCORDION SUSCEPTOR FOR MICROWAVE PREPARATION OF COOKIES

This application is a 371 filing International Patent Application PCT/EP2008/055284 filed Apr. 29, 2008, which claims the benefit of application no. 60/915,276 filed May 1, 2007.

FIELD OF THE INVENTION

The present invention relates generally to the field of food packaging for microwaveable cookie dough. In particular, the present invention relates to an innovative packaging for preparing accordion shaped cookies in a microwave.

BACKGROUND OF THE INVENTION

Household microwave ovens have been widely used for food preparation. But certain foods, such as cookie dough, are considered unsuitable for microwave preparation. The main problem with microwave baking is the lack of browning and crisping of the dough. It is well known that susceptor materials can be used to ameliorate this problem. When a cookie dough is baked on a sheet of susceptor, however, only the underside which contacts the susceptor is browned and crisped, and the upper part is not affected. Even placing the cookie dough between two parallel flat layers of susceptor sheets will not ensure good baking qualities because the cookie dough flows during baking with the upper surface of the cookie tending to be dome shaped. This flowing leads to uneven heating of the upper surface, resulting in burned and/or pale spots. Thus, there is a need for improvement in susceptors for microwave baking of cookies, and these are now provided by the present invention.

SUMMARY OF THE INVENTION

The present invention provides for an innovative packaging for microwave preparation of expandable food, such as cookies, an innovative food product prepared from the packaging and the method of preparation thereof The innovative packaging includes first and second susceptor sheet portions each having an accordion-like shape; one or more members for spacing the susceptor sheet portions at a predetermined distance; and an expandable uncooked food placed between the two susceptor sheets, wherein the food is in intimate contact with sheet portions and becomes efficiently browned and crisped during microwave cooking.

In one embodiment of the present invention, the dough of the innovative packaging can be expanded to a given outer diameter to provide more surface area to be browned and crisped.

In another embodiment of the present invention, the desired thickness of the dough is achieved by adjusting the height of the one or more members. Preferably, the spacing between the member(s) is uniform so that the thickness of the baked dough is uniform and is about 0.5 to 0.8 cm. Alternatively, the susceptor sheet portions are spaced by varying distances in different portions or regions to provide different cooked features to the product.

In yet another embodiment of the present invention, a device to keep the susceptor sheet at a constant distance during baking is associated with the susceptor sheet portions.

In one preferred embodiment of the present invention, the food is a cookie dough of a desired shape although other bakable or microwave cookable food products, shapes and configurations can instead be used. Combinations of different foods can also be used if desired.

The present invention also provides for expandable food such as cookies prepared from the innovative packaging, which are soft in the interior and browned and crisped on the outside. The cookie of the present invention maintains the wave-like shape of the cookie dough except that it has a larger diameter due to lateral expansion of the cookie dough during cooking. The thickness of the cookie is even and, preferably, is about 0.5 to 0.8 cm.

The present invention also provides for a method of preparing expandable food such as cookies using the innovative packaging of the present invention. Owing to the increased surface contact between the dough and the susceptor material, the cooking time is reduced in comparison to that of conventional packagings using flat susceptor sheets.

The invention also relates to the use of a packaging for the microwave preparation of expandable food, characterized in that the packaging comprises first and second susceptor sheet portions each having an accordion-like shape and one or more members for spacing the susceptor sheet portions at a predetermined distance, such that an expandable uncooked food can be placed between the two susceptor sheets, wherein the food is in intimate contact with sheet portions, and the food becomes efficiently browned and crisped during microwave cooking.

Another aspect of the invention relates to a packaged product comprising a holding member for retaining therein a plurality of packagings according to the invention. Preferably, the holding member and plurality of packagings are placed in a plastic pouch and stored at refrigeration temperatures during transport, handling and storage prior to use.

A further aspect of the invention relates to the use of first and second susceptor sheet portions each having an accordion-like shape and one or more members for spacing the susceptor sheet portions at a predetermined distance for forming a packaging for an expandable uncooked food product, such that the packaging can be used for transport and sale of the uncooked food as well as for microwave cooking of the food. A preferred uncooked food is a cookie dough and the sheet portions are useful for microwave baking of cookies. The other embodiments of the packaging can also be included in these uses.

BRIEF DESCRIPTION OF THE DRAWINGS

The following figures illustrate the invention without limiting it:

FIGS. 1A and 1B are schematic representations of the innovative packaging for microwave preparation of accordion-shaped cookies, with FIG. 1A showing a side view while FIG. 1B shows a top view.

DETAILED DESCRIPTION OF THE PREFERRED EMBODIMENTS

Surprisingly, it is now discovered that enclosing an expandable food such as a cookie dough between two accordion shaped susceptor sheets at a relatively constant distance makes it possible to use a microwave to produce browned and crisped cookies having a soft interior. This design of the susceptor restricts the spread of the cookie so that there is efficient contact between the dough and the susceptor material. Moreover, since the surface area of the cookie can be increased at a given outer diameter, more surface area can be browned and crisped. Furthermore, the relatively constant thickness of the cookie dough leads to even baking and optimized texture, in contrast to the uneven heating of the upper surface of the cookie dough when the spread is unrestricted.

Thus, the present invention meets the need of the industry by providing a more efficient crisping and browning of the surface to improve the baking of raw dough, such as cookie dough, in microwave ovens.

Figure 1A:
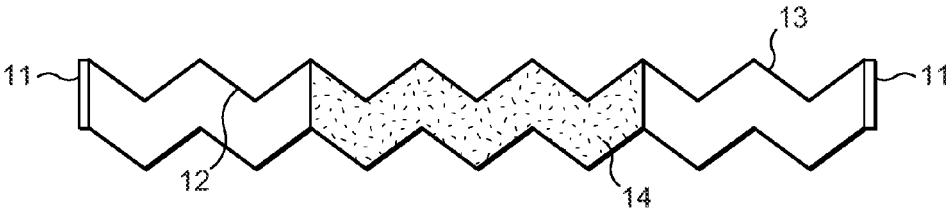
Figure 1B:
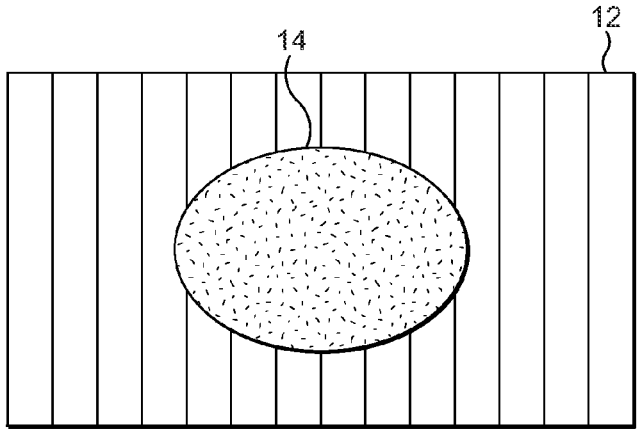

As shown in FIGS. 1A and 1B, in the present invention, the innovative packaging for microwave preparation of expandable food comprises: (i) two susceptor sheets each creased to form an accordion-like shape, wherein each sheet has an outer surface (13), and an inner surface (12) which faces each other and is covered with a susceptor material capable of absorbing microwave energy to heat, brown and crisp the food; (ii) two identical spacers (11) located on two opposite ends of the susceptor sheets to keep the sheets at a distance from each other; (iii) a raw dough (14), such as a cookie dough, placed in between the inner surfaces (12) of the two susceptor sheets in such a way that the dough (14) is made into a wave-like shape, wherein the dough (14) is constantly in intimate contact with the susceptor material and becomes efficiently browned and crisped during microwave cooking; and (iv) a device to keep the two susceptor sheets at a constant distance during cooking, when the dough expands, to ensure efficient contact between the dough and the susceptor material so as to achieve even baking and optimized texture.

Figure 1C:
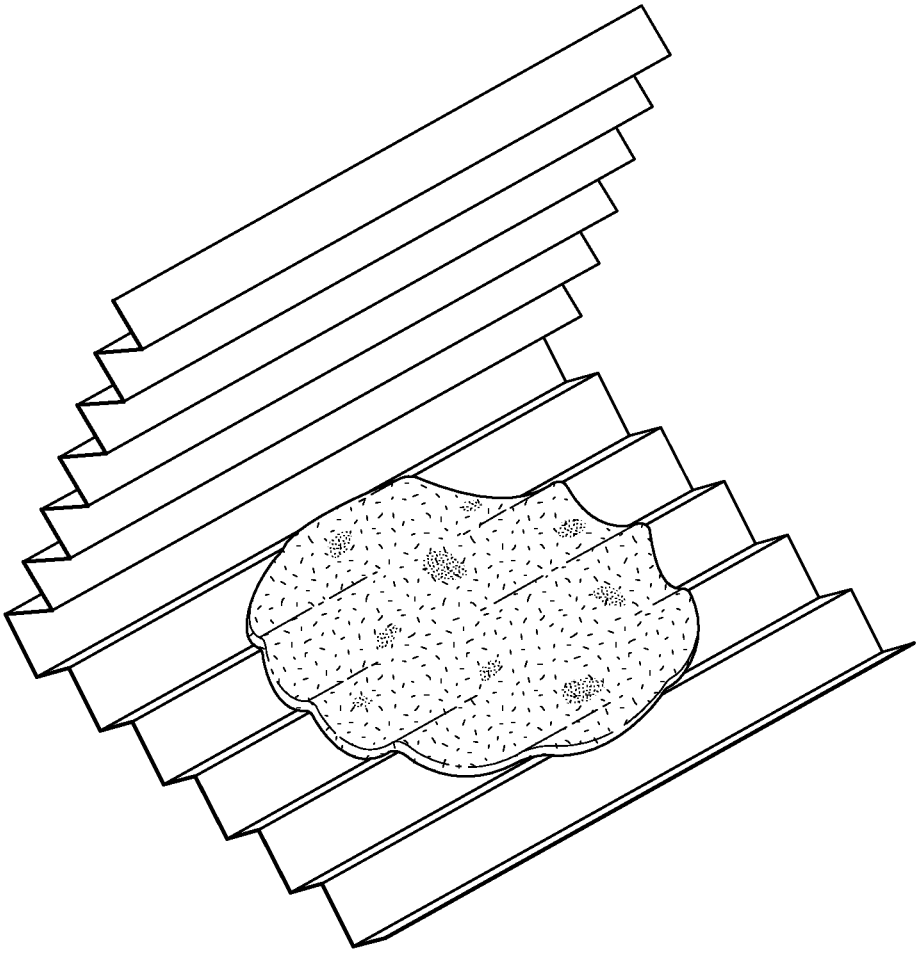
FIGS. 1C and 1D illustrate cookie dough being placed within a single sheet susceptor before (FIG. 1C) and after (FIG. 1D) microwave baking.
Figure 1D:
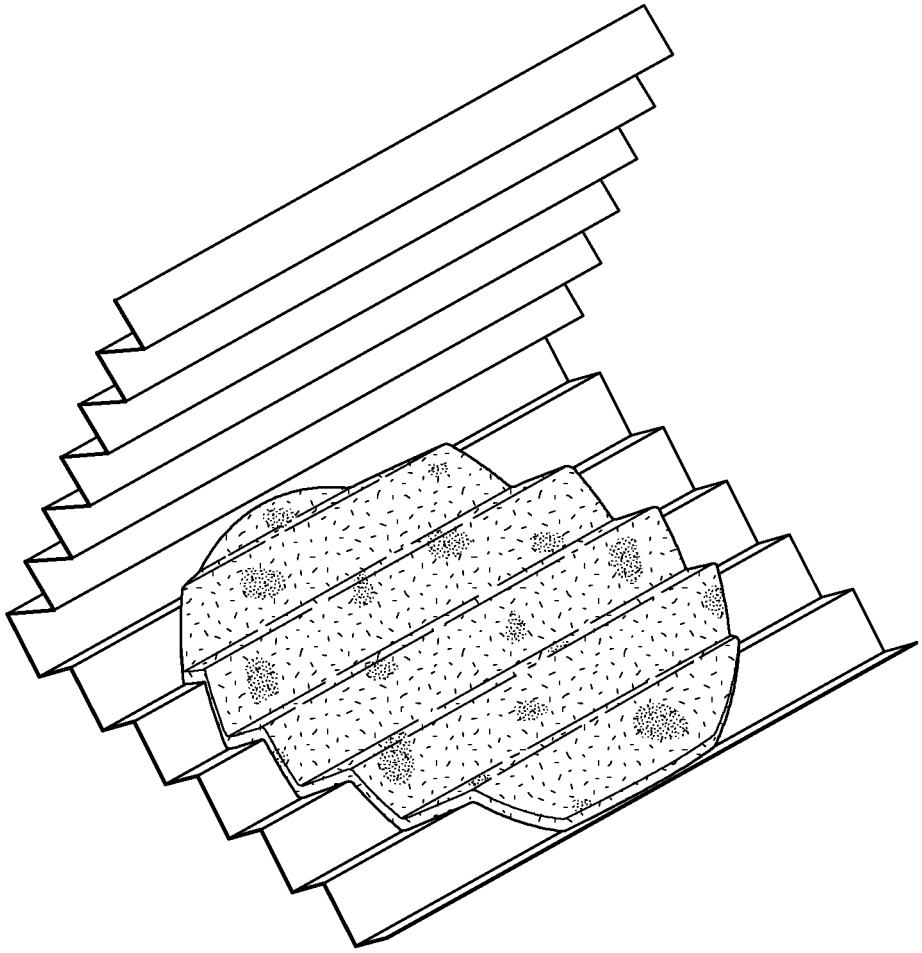

In the innovative microwave packaging of the present invention, the spread of the dough is restricted by the design of the susceptor and such restriction makes it possible to shape the dough to the designed thickness and geometry prior to baking and maintains the shape during baking. Since the thickness of the dough is maintained by the design of the packaging, during baking, the dough can only expand laterally, which leads to the increase of the outer diameter of the dough, giving more surface area to be browned and crisped. FIG. 1C illustrates the cookie dough on the susceptor before it is closed and prior to baking while FIG. 1D illustrates the enlarged baked cookie after baking and opening of the susceptor. While a round cookie is shown, it is recognized that essentially any shape can be used, include round, oval, polygonal, or combinations thereof, or the dough can be provided in a desired shape, such as of a star, animal, tree or the like. This is not a critical feature of the invention and it is only limited by the imagination of the skilled artisan in making a desirable baked or cooked product for consumption.

Figure 2:
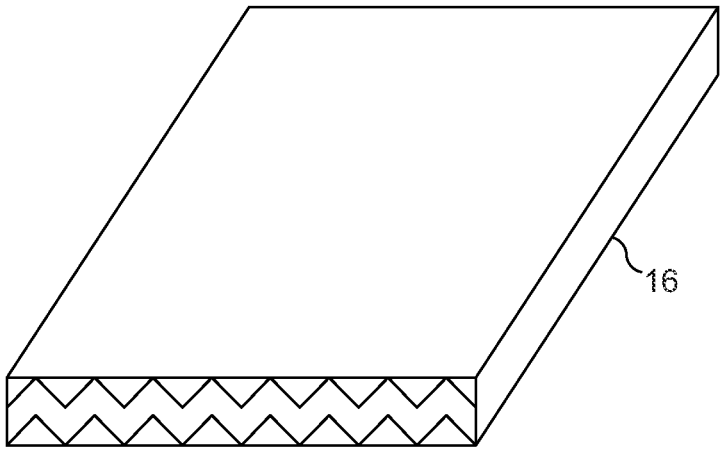
FIG. 2 illustrates a rectangular sleeve which includes therein an accordion susceptor according to the invention.

When placed between the sheets, the spacers (11) maintain the distance and spacing between the sheets. As the cookie dough will try to expand during cooking, an additional member or packaging is needed to apply force onto the sheets to prevent them from moving apart during microwave cooking. This can conveniently be achieved by placing the sheets and spacers within a rectangular packaging sleeve (16) as shown in FIG. 2. The two susceptor sheets, between which the cookie dough is placed, are held together by the sleeve (16). The sleeve provides adequate pressure to hold the susceptors together and ensure the wavy or ridged shape when the dough is baked.

Alternatively, the spacers 11 can be configured to engage the ends of the sheets in such a manner that a portion of the spacer maintains the internal spacing and distance, while other portions of the spacer engage the outer edges of the sheets to maintain them in the desired position as the cookie dough tries to expand during microwave baking.

Figure 3:
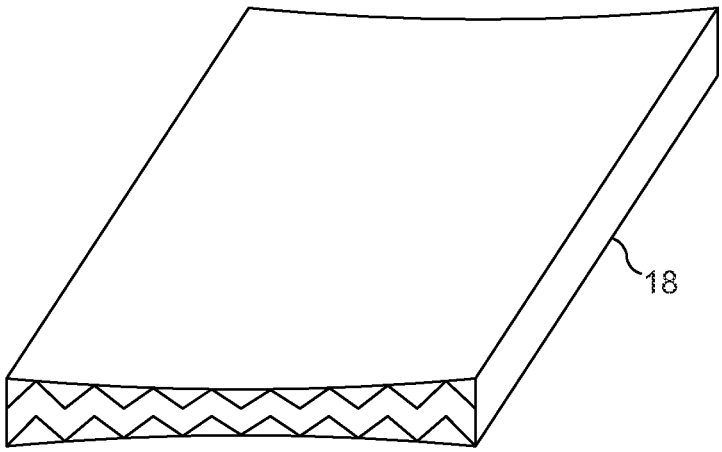
FIG. 3 illustrates a concave arrangement which applies additional force to prevent the cookie dough therein from expanding during baking.

FIG. 3 illustrates a variation of the sleeve where it is configured to be concave (18). This applies additional pressure or force along the centerline of the sleeve (18) and onto the center portion of the susceptor to either provide additional force against the dough as it is baking, or to allow for some expansion so that, after baking the cookie will have a uniform thickness achieved by the final uniform spacing of the accordion sheets.

Figure 4A:
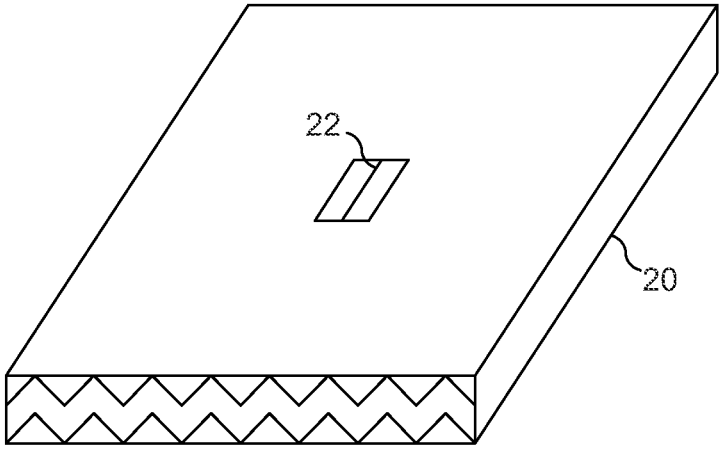
FIGS. 4A and 4B illustrate a push tab which locks into a V-groove of the susceptor to apply pressure onto the sheets to maintain the internal spacing at a desired distance, with FIG. 4A being a perspective view and FIG. 4B being a front side view.
Figure 4B:
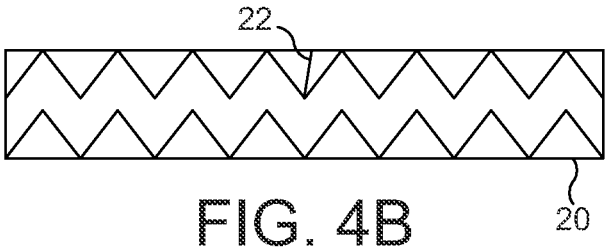

FIG. 4 illustrates another sleeve (20) that includes a locking tab (22) that applies similar pressure or force on the center of the susceptor to maintain the sheets in the desired spacing.

Another way to hold the susceptors in the desired spaced relation would be to have the accordion susceptor affixed to the sleeve so it is all one piece. The sleeve would be wrapped around the cookie dough and glued at the side seam. The sleeve would apply pressure to the cookie to maintain the wavy or ridged form during baking. Thereafter, to remove the baked cookie, a tear notch or other opening feature could be activated on the side of the sleeve, allowing the whole sleeve to be unwrapped and the cookie easily exposed.

In contrast to conventional packagings where the dough could spread unrestrictedly, the thickness of the dough in the innovative packaging of the present invention is kept constant so that even baking and optimized baked texture can be achieved. Alternatively, the packaging can be configured and dimensioned so that some portions of the cookie are thinner or thicker than others to provide crispier or more fully baked portions in the thinner areas.

In one embodiment of the present invention, the desired thickness of the dough of the innovative packaging is achieved by adjusting the height of the spacers. Preferably, the thickness of the dough is in the range of about 0.5 to 0.8 cm.

In one preferred embodiment of the present invention, the raw dough of the innovative packaging is a conventional cookie dough. The susceptor can be packaged with the dough in a refrigerated state so that it can be easily moved from the refrigerator and into the microwave oven for quick and easy preparation of the cookies.

The present invention also provides for an innovative food product prepared from the microwave packaging of the present invention. When the raw dough in the innovative packaging is cookie dough, the cookie prepared from the packaging can be uniformly baked or can be provided to be soft in the interior and browned and crisped on the outside. The cookie of the present invention maintains the wave-like shape of the cookie dough except that it has a larger diameter due to lateral expansion of the cookie dough during cooking. The thickness of the cookie is even and, preferably is about 0.5 to 0.8 cm both before and after baking.

Figure 5A:
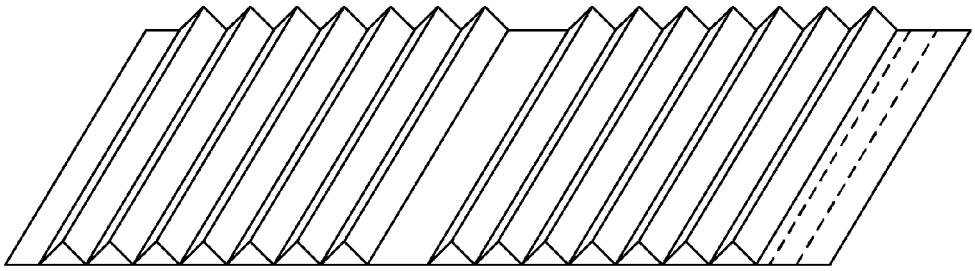
FIGS. 5A and 5B illustrate a one-piece wrap around accordion susceptor, with FIG. 5A showing the susceptor in an open position and FIG. 5B showing the susceptor opened after baking a cookie therein.
Figure 5B:
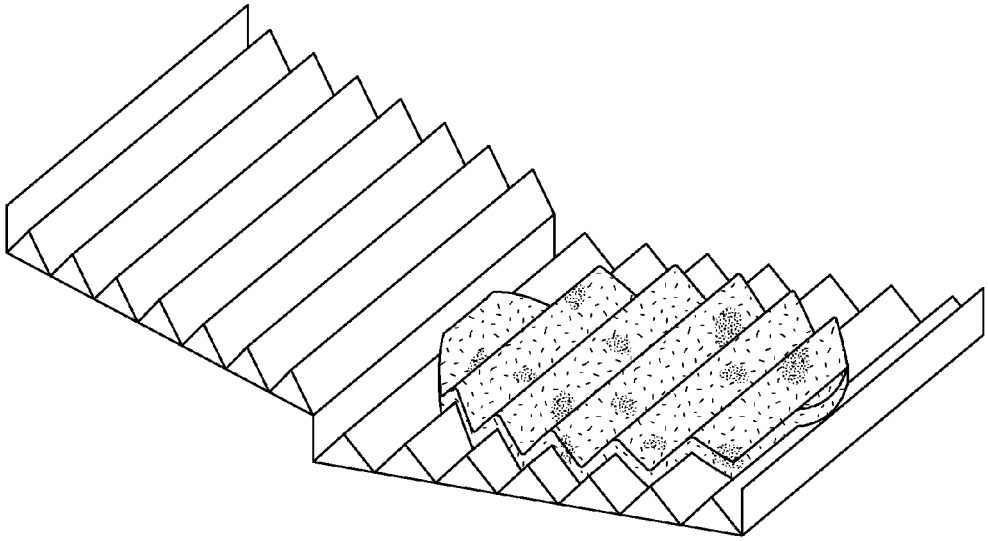

FIGS. 5A and 5B illustrate a convenient one-piece wrap-around susceptor. This enables the cookie dough to be placed on the sheet before folding it to provide the upper and lower sheets around the dough. This sheet can be provided with interlocking ends that maintain the desired spacing therebetween, or it can include one of the spacers described herein. It also can be provided in the rectangular packaging sleeve of FIG. 6.

The single sheet susceptor of FIG. 5A is a preferred embodiment of the invention. The sheet is opened in a flat configuration as shown in FIG. 5A to allow placement of the dough thereon, and then is folded and closed upon the dough to form the packaging. The packaging can be used both for sales and distribution of the uncooked dough in a variety of ways. For distribution of single cookies, a single packaging can be placed within an outer wrapping which is generally of plastic material. This sleeve would fit tightly around the susceptor and apply pressure to hold it together so that the cookie cannot move or shift in the packaging during transport and handling. When the cookie is to be baked, the consumer simply purchases the package, removes the plastic wrapping, places the susceptor in the microwave and bakes the cookie. FIG. 5B illustrates the susceptor after opening to expose the final baked cookie, which is of larger size and which includes the accordion pleats in its structure.

The susceptor material is preferably a relatively stiff material such as paperboard that includes a metal surface, such as aluminum on one surface to assist in focusing the microwaves on the dough. And while the preferred embodiment illustrates dough for forming a single cookie in the susceptor, a skilled artisan would realize that depending upon the size and shape of the susceptor, a few cookies, e.g., 2 to 5 or more depending upon the final baked cookie size and the length and width of the susceptor, can be baked in one susceptor. Of course, the largest size of the susceptor that would be conveniently made and used would be one that would fit into conventionally sized microwave ovens.

Figure 6:
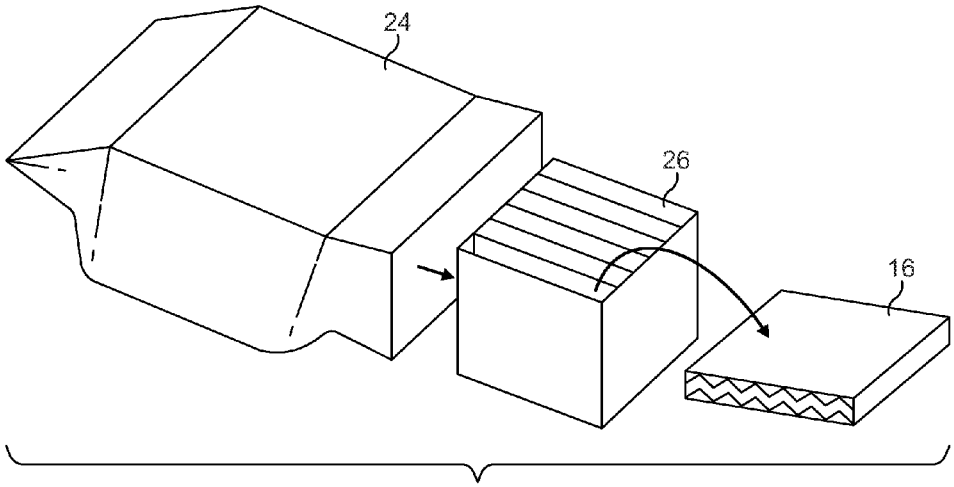
FIG. 6 is an exploded view of one susceptor which is removed from a rectangular holding member and which in turn is removed from a plastic packaging pouch.
Figure 7:
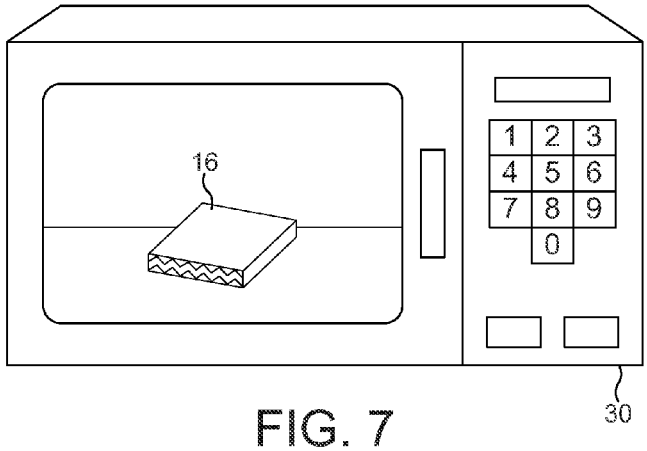
FIG. 7 is a view of the susceptor which is removed from the rectangular holding member of FIG. 6 and placed in a microwave oven for baking.

As consumers tend to prepare multiple cookies when baking, a larger package can be prepared for transport and sales. This is shown in FIG. 6 in the form of a plastic pouch (24) contains a number of susceptors which are each placed in a rectangular holding member (26). The individual susceptors and sleeves (16) can be stacked and placed into the holding member (26) before being placed into the pouch (24) for shipping and sale. The holding member (26) provides sufficient force on eth sleeves so that they are maintained therein to prevent against movement of the sleeves or the cookie dough therein during transport and handling. When cookies are to be baled, the consumer removes the holding member (26) from the pouch (24) and then removes one or more susceptors and sleeves (16) for baking. A single susceptor and sleeve (16) is shown in FIG. 6 removed from the pouch (24) and holding member (26) and is ready for baking. FIG. 7 is a view of the removed susceptor and sleeve (16) of FIG. 6 which is now placed in a microwave oven (30) for baking.

The present invention also provides for a method of preparing expandable food such as cookies by applying microwave energy to the innovative packaging of the present invention. Owing to the increased surface contact between the dough and the susceptor material, for a given dough weight and diameter, the method of the present invention requires less cooking time than that of conventional packagings using flat susceptor sheets. Additionally, baking is more even in the present method since it starts from a thinner shape and has more surface contact. And as noted herein, the susceptor can be designed with an internal spacing that either provides a uniform thickness to the uncooked product so that it bakes uniformly, or with varying spacings in certain areas or regions so that different cooked characteristics can be provided, e.g., more highly baked crispy portions in one region and lesser baked softer portions in other regions.

It is understood that the preferred embodiment is of a cookie dough although other food products can be made. An advantageous uncooked product is a bakery dough for forming a bread, crackers, rolls, biscuits, pie crusts, pizza dough, or bagels.

EXAMPLES

Example 1

Preparation of a Microwave Cookie Dough Packaging

Steps of preparation:

1) take two susceptor sheets coated with a susceptor material such as aluminum on one side (the inner surface) and fold them each to form an accordion-like shape;

2) lay one of the susceptor sheets on the counter with the inner surface facing up and put two spacers on the left and right edges of the susceptor sheet;

3) prepare a conventional cookie dough an place one round, oval or polygonal cookie dough shape onto the sheet, recognizing that the size of the dough is not critical and would generally be around 5 to 10 cm (2 to 4 inches) in diameter;

4) lay the other folded susceptor sheet on top of the dough with the inner surface of the susceptor sheet facing the dough;

5) utilize the spacer or packaging disclosed herein to hold the sheets in the desired spacing relation.

If the one piece construction of FIG. 5A is used, the same steps are followed except that the sheet is folded rather than having two separate sheets placed above each other.

Example 2

Baking an Accordion-Shaped Cookie in a Microwave Oven

As noted, the product is generally maintained in a refrigerated state (i.e., around 5° C.).

While it is possible to freeze this package and store it under freezer conditions (i.e., less than 0° C.), this would require thawing of the package prior to baking, thus extending the time for making the cookies. Accordingly, refrigerated storage of the product is sufficient and preferred.

The packaging prepared in Example 1 is removed from the refrigerator (or removed from the freezer and thawed) prior to being placed into a household microwave oven and heated for 30 seconds on a HIGH cooking energy. Upon completion, take out the packaging from the microwave oven and allow it to cool from a few minutes. The sleeve is removed to provide access to the baked cookie as shown in FIG. 1D. As noted herein, the cookie that is prepared can be uniformly baked or can be soft in the interior and browned and crisped on the outside. The baked cookie also has a wavy surface although it also has a generally uniform thickness.

What is claimed is:

1. A packaging for microwave preparation of a cookie having an accordion-like shape comprising:

first and second susceptor sheet portions each having an accordion-like shape, the same uniform sheet thickness, and an inner surface comprising a susceptor material capable of absorbing microwave energy to heat, brown and crisp the cookie dough that is placed adjacent the susceptor sheet portions;

one or more spacing members configured and dimensioned to maintain the susceptor sheet portions at a predetermined distance relative to each other to control the thickness of the cookie dough and provide a uniform thickness of the cookie dough that is placed between the susceptor sheet portions;

an additional member to prevent the susceptor sheet portions from moving apart during microwave cooking so that the baked cookie thickness is the same as the thickness of the cookie dough; and an expandable uncooked cookie dough comprising a upper surface in constant contact with the inner surface of the first susceptor sheet portion and a bottom surface in constant contact with the inner surface of the second susceptor sheet portion, wherein the constant surface contact between the cookie dough and the susceptor sheet portions forms the accordion-like shape of the cookie and causes the cookie dough to become browned or crisped during microwave cooking while the spacing member(s) and additional member prevent the cookie thickness from expanding during microwave cooking but allows the dough can only expand laterally, leading to an increase of the outer diameter of the cookie dough and providing more surface area to be browned and crisped in order to maintain the thickness of the baked cookie at the same thickness as the uncooked cookie dough.

2. The packaging of claim 1 wherein the one or more spacing members engage the ends of the susceptor sheet portions to maintain the desired spacing.

3. The packaging of claim 2 wherein the one or more spacing members space the susceptor sheet portions by about 0.5 to 0.8 cm.

4. The packaging of claim 1, wherein the additional member comprises a sleeve or locking mechanism to maintain the susceptor sheet portions at a constant distance during microwave cooking and baking of the cookie dough.

5. A packaging for microwave preparation of a cookie having an accordion-like shape comprising:

first and second susceptor sheet portions each having an accordion-like shape, the same uniform sheet thickness, and an inner surface comprising a susceptor material capable of absorbing microwave energy to heat, brown and crisp the cookie dough that is placed adjacent the susceptor sheet portions;

one or more spacing members configured and dimensioned to maintain the susceptor sheet portions at a predetermined distance relative to each other to control the thickness of the cookie dough and provide a uniform thickness of the cookie dough that is placed between the susceptor sheet portions;

an additional member comprising a sleeve or locking mechanism to maintain the susceptor sheet portions at a constant distance during microwave cooking and baking of the cookie dough to prevent the susceptor sheet portions from moving apart during microwave cooking so that the baked cookie thickness is the same as the thickness of the cookie dough;

a plastic wrapping surrounding the sleeve: and an expandable uncooked cookie dough comprising a upper surface in constant contact with the inner surface of the first susceptor sheet portion and a bottom surface in constant contact with the inner surface of the second susceptor sheet portion, wherein the constant surface contact between the cookie dough and the susceptor sheet portions forms the accordion-like shape of the cookie and causes the cookie dough to become browned or crisped during microwave cooking while the spacing member(s) and additional member prevent the cookie thickness from expanding during microwave cooking but allows the dough can only expand laterally, leading to an increase of the outer diameter of the cookie dough and providing more surface area to be browned and crisped in order to maintain the thickness of the baked cookie at the same thickness as the uncooked cookie dough.

6. The packaging of claim 1 wherein the susceptor sheet portions are provided as part of a single sheet that is folded to provide the first and second susceptor sheet portions around the cookie dough.

7. A packaged product comprising a holding member for retaining a plurality of packagings according to claim 4.

8. The packaged product of claim 7 placed in a plastic pouch and stored at refrigeration temperatures.

9. The packaging of claim 1 wherein the accordion-like shape of the susceptor and cookie dough comprises a plurality of generally V-shaped ridges and valleys and the cookie dough has a uniform thickness.

10. The packaging of claim 1, wherein the first and second susceptor sheet portions are spaced by varying distances in different regions of the susceptor sheet portions to provide different cooked features to the cookie.

11. A method of preparing a cookie having an accordion-like shape comprising preparing a packaging according to claim 1, with a cookie dough between two susceptor sheet portions that are spaced by a uniform distance; and applying microwave energy to the packaging so that the cookie dough is heated and cooked by the microwave energy.

12. The method of claim 11, wherein the cooking time is reduced in comparison to that of conventional packaging using flat susceptor sheets owing to the increased surface contact between the dough and the accordion susceptor sheet portions.

13. The method of claim 11, wherein the susceptor sheet portions are spaced by varying distances in different portions to provide different cooked features to the cookie.

14. The method of claim 11, wherein the cookie thus prepared has a round, oval or polygonal configuration, a wavy shape and a uniform thickness, wherein the interior of the cookie is soft and the outside of the cookie is browned and crisped.

15. The method of claim 11, wherein the cookie thus prepared maintains the wave-like shape of the cookie dough except that it has a diameter larger than that of the cookie dough due to lateral expansion of the cookie dough during cooking.

16. The method of claim 11, wherein the cookie thus prepared has a desired shape and a uniform thickness of about 0.5 to 0.8 cm.

* * * * *